US007530798B2

(12) United States Patent
Huttar et al.

(10) Patent No.: US 7,530,798 B2
(45) Date of Patent: May 12, 2009

(54) MULTISTAGE COMPRESSOR FOR COMPRESSING GASES

(75) Inventors: Ernst Huttar, Klosterneuburg (AT); Grimbert Tschinkel, Bad Vöslau (AT)

(73) Assignee: Leobersdorfer Maschinenfabrik AG, Vienna (AT)

( * ) Notice: Subject to any disclaimer, the term of this patent is extended or adjusted under 35 U.S.C. 154(b) by 493 days.

(21) Appl. No.: 10/481,495

(22) PCT Filed: Jul. 23, 2002

(86) PCT No.: PCT/AT02/00218

§ 371 (c)(1),
(2), (4) Date: May 17, 2004

(87) PCT Pub. No.: WO03/010436

PCT Pub. Date: Feb. 6, 2003

(65) Prior Publication Data

US 2004/0197197 A1 Oct. 7, 2004

(30) Foreign Application Priority Data

Jul. 25, 2001 (AT) ..... A 1159/2001

(51) Int. Cl.
*F04B 39/00* (2006.01)

(52) U.S. Cl. ..... 417/313; 417/243

(58) Field of Classification Search ..... 417/201, 417/205, 362, 244–268, 313, 24; 418/DIG. 1
See application file for complete search history.

(56) References Cited

U.S. PATENT DOCUMENTS 4,529,363 A * 7/1985 Suzuki ..... 417/295
4,594,858 A * 6/1986 Shaw ..... 62/175
4,618,310 A * 10/1986 Michelson ..... 415/1
4,662,826 A 5/1987 Nitta et al.

FOREIGN PATENT DOCUMENTS

GB 2277462 11/1994

OTHER PUBLICATIONS

English Abstract of RU 2187698 dated Aug. 20, 2002.

* cited by examiner

*Primary Examiner*—William H Rodriguez
*Assistant Examiner*—Vikansha S Dwivedi
(74) *Attorney, Agent, or Firm*—Ladas and Parry LLP

(57) ABSTRACT

A multistage compressor (1) for compressing gases has a low-pressure range (7) and a high-pressure range (4), the high-pressure range (4) including at least one reciprocating compressor (3) driven via a crankshaft (5) and the low-pressure range (7) including at least one screw compressor (20) provided as a low-pressure compressor (6) having a rotating displacer (8) coupled to the crankshaft (5) of the reciprocating compressor (3).

14 Claims, 1 Drawing Sheet

MULTISTAGE COMPRESSOR FOR COMPRESSING GASES

The invention relates to a multistage compressor for compressing gases, having a low-pressure range and a high-pressure range, said high-pressure range including at least one reciprocating compressor driven via a crankshaft and the low-pressure range including at least one low-pressure compressor comprising a rotating displacer coupled to the crankshaft of the reciprocating compressor. For the actuation of the crankshaft, an electromotor, an internal combustion engine, a steam turbine or the like may, for instance, be provided.

With reciprocating compressors, compression in the low-pressure range, which may comprise several compression stages, is disadvantageous on account of the compressibility of the medium to be compressed, since very large reciprocating pistons and cylinder volumes are required, particularly at an intake in the atmospheric pressure range. Such large cylinders, on the one hand, give rise to technical problems because of the unfavorable stroke/bore ratio (the piston strokes of all compressor stages usually being identical and the cylinder diameters varying in the individual pressure stages) and, on the other hand, involve extremely high costs due to the dimensions of the valves, piston rings, etc.

For low-pressure range compression it has already been known to use compressors (e.g., screw compressors, rotary compressors, etc.) which are driven independently of a consecutively arranged reciprocating compressor and which operate more efficiently in the low-pressure range than reciprocating compressors. The thus precompressed medium is then conducted on into a first compression stage in the consecutively arranged reciprocating compressor, where it is further compressed. In doing so, it is, however, disadvantageous that the separate driving unit required for the low-pressure compressor calls for relatively large and expensive multistage compressors.

Furthermore, a multistage reciprocating compressor prototype manufactured by Bauer Kompressoren GmbH and exhibited at the Gastec Fair in Vienna in 1995 is known. That multistage compressor comprises a separate reciprocating compressor directly coupled to the crankshaft of a consecutively arranged multistage reciprocating compressor. The reciprocating compressor directly coupled to the crankshaft of a consecutively arranged multistage reciprocating compressor in that case merely serves to suck empty the driving gear of the consecutively arranged multistage reciprocating compressor. The previously mentioned disadvantages of a reciprocating compressor in the low-pressure range are thereby not overcome though.

In addition, an air compressor for aircraft engines is known from GB-597 437 A, wherein a rotary compressor is provided in a low-pressure range and the air precompressed by the rotary compressor is subsequently fed to a multistage reciprocating compressor. The rotary compressor and the reciprocating compressor are both driven by a common crankshaft. Yet, it involves the disadvantage that a precompression of no more than 2.5 bar can be reached by the rotary compressor having dry lamellae.

GB-540 580 A likewise discloses an air compressor, in which a Roots blower is provided to precompress air which is then conducted into a reciprocating compressor for further compression. In that multistage compressor, the crankshafts of the reciprocating compressors are coupled with the drive shaft of the Roots blower not directly, but via belts. Again, precompression by the Roots blower is very low (2 bar at most).

It is the object of the invention to provide a multistage compressor and, in particular, a stationary compressor, which exhibits a compact mode of construction and, at the same time, is suitable for a comparatively high compression, wherein a higher pressure level than hitherto known is to be reached already by low-pressure compression. Moreover, the multistage compressor is to be produced in a relatively cost-effective manner on account of its compact mode of construction.

The multistage compressor according to the invention of the initially defined kind is characterized in that at least one screw compressor is provided as said low-pressure compressor. By coupling the screw compressor to the crankshaft of the consecutively arranged reciprocating compressor, a multistage compressor is provided in which a separate drive unit for the low-pressure compressor can be obviated, while a comparatively high precompression of up to a maximum of approximately 40 bar is at the same time obtained in the low-pressure range.

In order to ensure a particularly compact and structurally simple configuration of the compressor according to the invention, it will be beneficial if the displacer of the screw compressor is directly coupled to the crankshaft of the reciprocating compressor. Such a direct screw compressor/reciprocating compressor coupling not only allows for the omission of a separate drive unit for the screw compressor, but also enables the screw compressor to be directly driven by the crankshaft of the reciprocating compressor without providing an intermediate gear—at the appropriate speed of the crankshaft.

For special applications of the multistage compressor, it is advantageous with a view to providing a flexible arrangement of the screw compressor relative to the crankshaft of the reciprocating compressor, if the displacer of the screw compressor is coupled to the crankshaft of the reciprocating compressor by the aid of a coupling device transmitting the torque of the crankshaft. In this case it will be favorable in most cases if a coupling device transmitting the speed of the crankshaft one-to-one is simply provided. A structurally simple configuration of the coupling between the displacer of the low-pressure stage and the crankshaft of the high-pressure stage will be ensured, if a chain drive or belt drive is provided as said coupling device.

In order to enable a multiplication or reduction of the speed of the crankshaft relative to the speed of the displacer of the screw compressor, it is advantageous if a toothed gearing is provided as said coupling device. Likewise, it may be beneficial in respect to the modular use of different previously arranged screw compressors, if a separable coupling device is provided.

With a view to providing a particularly compact configuration of the multistage compressor, a reliable suction at atmospheric pressure and, in particular, favorable mounting conditions of the drive shaft and the crankshaft, respectively, it is advantageous if the screw compressor is arranged on the reciprocating compressor side facing away from a drive unit of the multistage compressor.

Since screw compressors effect an internal compression of the aspirated gas, thus raising the pressure and temperature of the gas, it is favorable if a cooling device is provided in the gas duct between the reciprocating compressor and the screw compressor, since this will both limit any increase in temperature and reduce the necessary compression work.

When compressing moist gases, and hence particularly air, a certain quantity of the condensable gas portion will condense at an intermediate cooling. It is, therefore, advantageous if a condensate separator is provided in the gas duct between the reciprocating compressor and the screw compressor.

In order to restrict to the admissible value the final compression temperature in a compressor stage, it is advantageous if the low-pressure compressor comprises several compression stages, since this will allow for operational savings as compared to single-stage compression, enhance the volumetric efficiency and reduce the propulsion forces. If the reciprocating compressor comprises several compression stages, the previously mentioned advantages will result as well.

In order to ensure an efficient compression of relatively large gas amounts, it is beneficial if several compression chambers are provided in parallel in a compression stage of the low-pressure compressor and/or the reciprocating compressor.

In order to ensure an efficient automatic control of the whole multistage compressor, it will be favorable if at least one control means is arranged between the individual compressor stages, said control means, for instance, being comprised of blow-off valves, by-pass valves, adjustable leak volumes, speed regulators and any other fittings. In particular, various mechanical, pneumatic, hydraulic, electric or electronic components may be employed for the control or regulation of the multi-stage compressor, thus enabling both on-site control or regulation and remote control or regulation.

In the following, the invention will be explained in more detail by way of preferred exemplary embodiments illustrated in the drawing, to which it is, however, not to be restricted. In detail, FIG. 1 represents a schematic view of a multistage compressor comprising a reciprocating compressor in the high-pressure range and a screw compressor;

Figure 1:
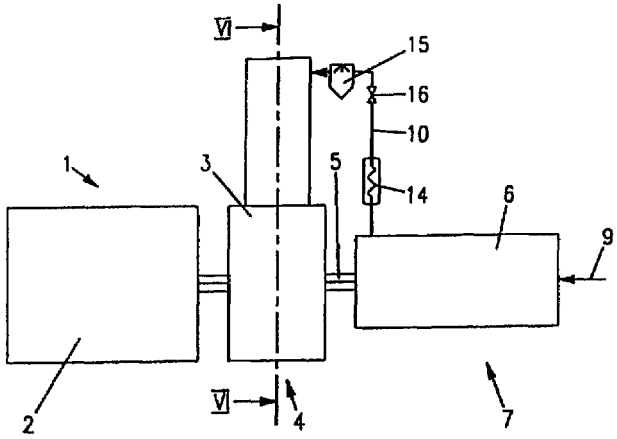

FIG. 1 is a schematic view of a multistage compressor 1, in which the reciprocating compressor 3 of a high-pressure range 4 is driven by a motor 2. As a low-pressure compressor 6, a screw compressor 20 (cf. FIG. 3) is coupled to the drive of the reciprocating compressor 3 in the low-pressure range 7, whereby a rotating displacer 8 of the screw compressor 20 is directly coupled to the crankshaft 5 of the reciprocating compressor 3. The direct coupling of the crankshaft 5 of the reciprocating compressor 3 with the displacer 8 of the screw compressor 20 results in an extremely compact mode of construction of the multistage compressor 1, and it is, moreover, readily feasible to provide a separate drive unit for the precompression of the gas subsequently high-compressed in the reciprocating compressor 3, by the aid of a screw compressor 20 comprising a rotating displacer 8. Unlike reciprocating compressors, screw compressors comprise compact, small and hence cost-effective structures, particularly at low-pressure intake of gas 9, yet a precompression of up to 40 bar is nevertheless feasible by means of the screw compressor 20.

The gas compressed in the screw compressor 20 is subsequently conducted into a first compressor stage 11 of the reciprocating compressor 3 (cf. FIG. 4) via a gas duct 10, wherein any desired control means may be arranged between the final compressor stage in the low-pressure range and a first compressor stage in the high-pressure range of the reciprocating compressor as well as individual compressor stages, e.g., 11, 12, 13 (cf. FIG. 4).

A cooling device 14 is shown, in particular, in FIG. 1 between the low-pressure compressor 6 designed as a screw compressor 20 (cf. FIG. 3) and the reciprocating compressor 3, whereby a certain gas portion of the gas compressed in the low-pressure compressor 6 is caused to condense, which may be separated from the gas by the aid of a separator 15. In addition, a valve 16 is apparent, via which mass flows can be supplied or discharged between the individual compressor stages.

Figure 2:
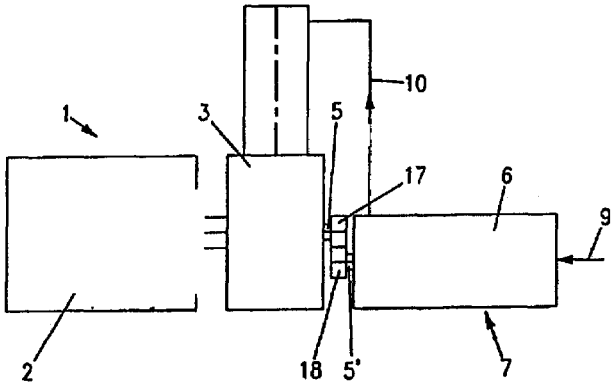
FIG. 2 represents a schematic view of the multistage compressor according to FIG. 1, yet with a coupling device being arranged between the low-pressure and high-pressure compressors.

FIG. 2 illustrates a multistage compressor 1 similar to that of FIG. 1, yet a toothed gearing 17 is interposed between the crankshaft 5 of the reciprocating compressor 3 and a drive shaft 5' of the displacer 8 (cf. FIG. 3) of the screw compressor 20 to form a coupling device 18 between the two shafts 5, 5'. Thus, a multiplication or reduction of the speed of the crankshaft 5 relative to the speed of the shaft 5' driving the displacer 8 of the screw compressor 20 can be effected by the aid of the gearing 17.

Figure 3:
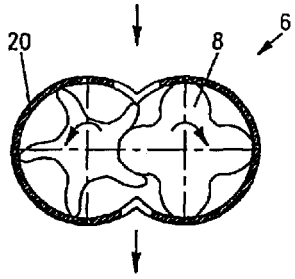
FIG. 3 is a schematic cross section through a screw compressor.

FIG. 3 is a detailed schematic illustration of the screw compressor 20, by which a precompression up to about 40 bar can be effected by the aid of a displacer 8 directly coupled to the crankshaft 5 of the reciprocating compressor 3.

Figure 4:
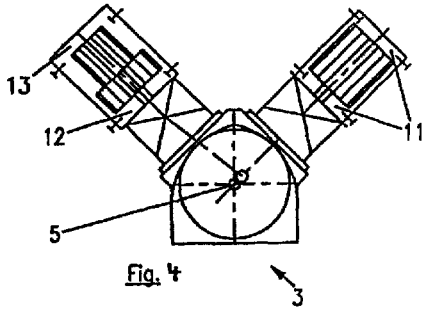
FIG. 4 is a section along line VI-VI of FIG. 1.

From the sectional illustration according to FIG. 4 it is apparent that the reciprocating compressor 3 comprises several compressor stages 11, 12, 13, wherein the volume of the cylinder of the first compressor stage 11, which is fed with the gas precompressed by the screw compressor 20 provided as a low-pressure compressor 6, is the largest one and the volumes of the consecutively arranged cylinders of compressor the stages 12, 13 decrease with the compression increasing. Fittings of any type (not illustrated) may be provided between the individual compressor stages 11, 12, 13 for blow-off control and the like as well as for speed regulation. What is essential here is that the crankshaft 5 of the reciprocating compressor 3 is coupled with the rotor 8 of a low-pressure compressor 6 either directly or via a coupling device.

The invention claimed is:

1. A multistage compressor for compressing gases, comprising:

a low-pressure range connected by a gas duct; and a high-pressure range, the high-pressure range including at least one reciprocating compressor driven via a crankshaft, the low-pressure range including at least one low-pressure compressor comprising a rotating displacer coupled to the crankshaft of the reciprocating compressor, wherein at least one screw compressor is provided as the low-pressure compressor, and a cooling device and a condensate separator are provided in the gas duct between the reciprocating compressor and the screw compressor, the screw compressor being arranged on a reciprocating compressor side facing away from a drive unit of the multistage compressor, and wherein the displacer of the screw compressor is directly coupled to the crankshaft of the reciprocating compressor such that the screw compressor is directly driven by the crankshaft of the reciprocating compressor.

2. A multistage compressor according to claim 1, wherein a chain drive or a belt drive is provided as the coupling device.

3. A multistage compressor according to claim 1, wherein a toothed gearing is provided as the coupling device.

4. A multistage compressor according to claim 1, wherein the low-pressure compressor comprises several compressor stages.

5. A multistage compressor according to claim 1, wherein the reciprocating compressor comprises several compressor stages.

6. A multistage compressor according to claim 1, wherein several compressor chambers are provided in parallel in a compression stage of at least one of the low-pressure compressor and the reciprocating compressor.

7. A multistage compressor according to claim 1, wherein at least one control means is arranged between the individual compressor stages.

8. A multistage compressor for compressing gases, comprising:

a low-pressure range connected by a gas duct; and a high-pressure range, the high-pressure range including at least one reciprocating compressor driven via a crankshaft, the low-pressure range including at least one low-pressure compressor comprising a rotating displacer coupled to the crankshaft of the reciprocating compressor, wherein at least one screw compressor is provided as the low-pressure compressor, and a cooling device and a condensate separator are provided in the gas duct between the reciprocating compressor and the screw compressor, the screw compressor being arranged on a reciprocating compressor side facing away from a drive unit of the multistage compressor, and wherein the displacer of the screw compressor is coupled to the crankshaft of the reciprocating compressor via a non-separable coupling device transmitting the torque of the crankshaft one-to-one such that the screw compressor is directly driven by the crankshaft of the reciprocating compressor.

9. A multistage compressor according to claim 8, wherein a chain drive or a belt drive is provided as the coupling device.

10. A multistage compressor according to claim 8, wherein a toothed gearing is provided as the coupling device.

11. A multistage compressor according to claim 8, wherein the low-pressure compressor comprises several compressor stages.

12. A multistage compressor according to claim 8, wherein the reciprocating compressor comprises several compressor stages.

13. A multistage compressor according to claim 8, wherein several compressor chambers are provided in parallel in a compression stage of at least one of the low-pressure compressor and the reciprocating compressor.

14. A multistage compressor according to claim 8, wherein at least one control means is arranged between the individual compressor stages.

* * * * *